US011198052B2

(12) United States Patent
Kahan et al.

(10) Patent No.: US 11,198,052 B2
(45) Date of Patent: Dec. 14, 2021

(54) CROSS SKATE SYSTEM AND METHOD OF OPERATION THEREOF

(71) Applicants: Abner Kahan, Brooklyn, NY (US); Caleb Kahan, Brooklyn, NY (US)

(72) Inventors: Abner Kahan, Brooklyn, NY (US); Caleb Kahan, Brooklyn, NY (US)

( * ) Notice: Subject to any disclaimer, the term of this patent is extended or adjusted under 35 U.S.C. 154(b) by 20 days.

(21) Appl. No.: 16/777,841

(22) Filed: Jan. 30, 2020

(65) Prior Publication Data

US 2020/0246678 A1 Aug. 6, 2020

Related U.S. Application Data

(60) Provisional application No. 62/799,735, filed on Jan. 31, 2019.

(51) Int. Cl.

| | |
|---|---|
| ***A63C 17/12*** | (2006.01) |
| ***A63C 17/04*** | (2006.01) |
| ***A63C 17/06*** | (2006.01) |
| ***A63C 17/14*** | (2006.01) |
| ***A63C 17/26*** | (2006.01) |
| ***A63C 17/22*** | (2006.01) |

(52) U.S. Cl.

CPC ..... *A63C 17/12* (2013.01); *A63C 17/045* (2013.01); *A63C 17/064* (2013.01); *A63C 17/14* (2013.01); *A63C 17/226* (2013.01); *A63C 17/262* (2013.01); *A63C 2203/12* (2013.01); *A63C 2203/42* (2013.01)

(58) Field of Classification Search

CPC ..... A63C 17/12; A63C 17/045; A63C 17/064; A63C 17/14; A63C 17/226; A63C 17/262

See application file for complete search history.

(56) References Cited

U.S. PATENT DOCUMENTS

| | | | | |
|---|---|---|---|---|
| 3,876,217 A * | 4/1975 | Copier | A63C 17/064 280/11.225 |
| 6,059,062 A * | 5/2000 | Staelin | B60L 15/2009 180/181 |
| 6,241,264 B1 * | 6/2001 | Page | A63C 17/045 280/11.19 |
| 7,204,330 B1 * | 4/2007 | Lauren | A63C 17/12 180/181 |
| 2003/0214103 A1 * | 11/2003 | Walker | A63C 17/26 280/11.203 |

(Continued)

*Primary Examiner* — James A Shriver, II
*Assistant Examiner* — Michael T. Walsh

(57) ABSTRACT

A device which may include first and second cross skate bodies each having a frame configured to support at least first and second wheels situated inline of each other, each frame having at least one compartment configured to position a corresponding power source of first and second power sources; first and second foot couplers, each foot coupler configured to couple a foot of a user to a corresponding cross skate body of the cross skate bodies; a first traction motor coupled to drive at least one of the first and second wheels of the first cross skate body; a second traction motor coupled to drive at least one of the first and second wheels of the second cross skate body; and a controller which may be configured to: receive a drive signal from a drive controller, and control the first and second traction motors to drive the corresponding wheels in accordance with the drive signal.

20 Claims, 11 Drawing Sheets

(56) References Cited

U.S. PATENT DOCUMENTS

| | | | | |
|---|---|---|---|---|
| 2006/0038364 | A1* | 2/2006 | Hsu | A63C 17/06<br>280/11.233 |
| 2007/0252354 | A1* | 11/2007 | Chen | A63C 17/12<br>280/87.042 |
| 2009/0066150 | A1* | 3/2009 | O'Rourke, Sr. | A63C 17/013<br>16/18 R |
| 2010/0117317 | A1* | 5/2010 | Smith | A63C 17/014<br>280/87.042 |
| 2012/0228045 | A1* | 9/2012 | Kim | A63C 17/12<br>180/206.8 |
| 2013/0106069 | A1* | 5/2013 | Kowalski | A63C 17/045<br>280/11.223 |
| 2013/0282216 | A1* | 10/2013 | Edney | A63C 17/14<br>701/22 |
| 2015/0352430 | A1* | 12/2015 | Treadway | A63C 17/12<br>701/22 |
| 2016/0375347 | A1* | 12/2016 | Stubberud | A63C 17/0006<br>701/79 |
| 2018/0221753 | A1* | 8/2018 | Chen | A63C 17/0033 |

* cited by examiner

CROSS SKATE SYSTEM AND METHOD OF OPERATION THEREOF

REFERENCE TO PRIORITY APPLICATION

This application claims priority to U.S. Provisional Application Ser. No. 62/799,735, filed Jan. 31, 2019, and entitled "CROSS SKATE SYSTEM AND METHOD OF OPERATION THEREOF," the contents of which are incorporated herein by reference in its entirety.

FIELD OF THE DISCLOSURE

The present system relates generally to cross skate apparatus, and more particularly to a cross skate apparatus, a controller for a cross skate apparatus, and a method of operation thereof.

BACKGROUND OF THE INVENTION

A cross skate is a cross between roller skis and inline roller skates, being shorter than the former but longer than the latter. The non-motorized version of a cross skate consists of a footboard mounted between a front wheel and a rear wheel. Cross skates can be difficult to turn, since a user has to physically lift their foot, and then point the cross skate in the direction where the user wishes to go. This process is cumbersome, and would present problems when the user needs to turn quickly. There have been several proposed solutions to the turning problem for roller skates and one for the non-motorized version of cross skates. U.S. Pat. No. 6,241,264 discloses a weight shifting mechanism for non-motorized cross skates, that is both complicated to manufacture and limits the range of turning motion of the cross skate.

A further disadvantage of conventional cross skates is that they are difficult to ride, since the user has to strenuously push off in order to move forward. Further, the industry has motorized bicycles, scooters, skateboards, and roller skates, but no commercially available motorized cross skate is known to exist.

Accordingly, embodiments of the present system may overcome these and other disadvantages of conventional cross skates and methods of operation thereof.

SUMMARY OF THE INVENTION

The system(s), device(s), method(s), arrangements(s), user interface(s), computer program(s), processes, etc. (hereinafter each of which will be referred to as system, unless the context indicates otherwise), described herein address problems in prior art systems.

In accordance with embodiments of the present system, there is disclosed a device which may include first and second cross skate bodies each having a frame configured to support at least first and second wheels situated inline of each other, each frame having at least one compartment configured to position a corresponding power source of first and second power sources; first and second foot couplers, each foot coupler configured to couple a foot of a user to a corresponding cross skate body of the cross skate bodies; a first traction motor coupled to drive at least one of the first and second wheels of the first cross skate body; a second traction motor coupled to drive at least one of the first and second wheels of the second cross skate body; and a controller which may be configured to: receive a drive signal from a drive controller, and control the first and second traction motors to drive the corresponding wheels in accordance with the drive signal.

It is further envisioned that the first and second traction motors may include hub-type motors. It is envisioned that the first and second traction motors may be coupled to at least one of the first and second corresponding wheels with a belt or chain. The controller may be configured to synchronously control the first and second traction motors. The compartment of each of the of the first and second cross skate bodies may be configured to at least partially house a corresponding power source of the first and second power sources. A drive controller may be provided and may include a handheld transmitter which may transmit a drive signal to synchronously control the first and second traction motors. The drive controller may include a user interface including a trigger with which a user may enter a desired power setting. It is further envisioned that the drive controller may be configured to synchronously control the first and second traction motors to enter acceleration or regenerative braking modes. It is also envisioned that first and second sensors may be configured to sense the speed of the first and/or second traction motors, respectively. The sensors may further include acceleration to detect roll pitch and/or yaw of each of the cross skates and/or drive controller. It is also envisioned that each of the first and second cross skate bodies may include a passive steering coupler for steerably coupling the first wheel to the corresponding cross skate body of the first and second cross skate bodies. The passive steering coupler may form a caster wheel. A damper may be provided to damp steering oscillation. It is also envisioned that first and second foot couplers may include straps, a boot, or a shoe.

In accordance with yet other embodiments, there is provided a device which may include first and second cross skate bodies each having a frame configured to support at least first and second wheels situated inline of each other, each frame having at least one compartment configured to position a corresponding power source of first and second power sources; a fork for supporting the first wheel of each of the skate bodies in a caster configuration; first and second foot couplers, each foot coupler may be configured to couple a foot of a user to a corresponding cross skate body of the cross skate bodies; a first traction motor coupled to drive at least the second wheel of the first cross skate body; a second traction motor coupled to drive at least second wheel of the second cross skate body; and a controller configured to: receive a drive signal from a drive controller, and control the first and second traction motors to drive the corresponding wheels in accordance with the drive signal. A steering damper may be provided and may be coupled to the fork and configured to damp movement of the fork attached thereto. It is also envisioned that the steering damper may be actively controlled by the controller. It is also envisioned that at least one sensor for detecting a position of one of the first and second cross skate bodies relative to the other and forming corresponding relative location information (RLI) may be provided. It is further envisioned that the controller may control at least one of the first traction motor and the second traction motor in accordance with the RLI.

In yet other embodiments, there is provided a cross-skate device which may include: first and second cross skate bodies each having a frame configured to support at least first and second wheels situated inline of each other, each frame having at least one compartment configured to position a corresponding power source of first and second power sources; first and second foot couplers, each foot coupler configured to couple a foot of a user to a corresponding cross skate body of the cross skate bodies; a first traction motor coupled to drive at least one of the first and second wheels of the first cross skate body; a second traction motor coupled to drive at least one of the first and second wheels of the second cross skate body; and a controller configured to: receive a drive signal from a drive controller, and control the first and second traction motors to drive the corresponding wheels in accordance with the drive signal. It is also envisioned that the first and second traction motors may include hub-type motors. It is also envisioned that the first and second traction motors may be coupled to at least one of the first and second corresponding wheels directly or with tensioning member such as a belt or chain.

BRIEF DESCRIPTION OF THE DRAWINGS

The present invention is explained in further detail in the following exemplary embodiments and with reference to the figures, where identical or similar elements may be partly indicated by the same or similar reference numerals, and the features of various exemplary embodiments being combinable. The invention is herein described, by way of example only, with reference to the accompanying drawings, wherein.

DETAILED DESCRIPTION OF THE INVENTION

Preferred embodiments of the present invention will now be described in detail with reference to the drawings. For the sake of clarity, certain features of the invention will not be discussed when they would be apparent to those with skill in the art.

The following are descriptions of illustrative embodiments that when taken in conjunction with the following drawings will demonstrate the above noted features and advantages, as well as further ones. For the sake of clarity, the drawings are not made to scale. In the following description, for purposes of explanation rather than limitation, illustrative details are set forth such as architecture, interfaces, techniques, element attributes, etc. However, it will be apparent to those of ordinary skill in the art that other embodiments that depart from these details would still be understood to be within the scope of the appended claims. Moreover, for the purpose of clarity, detailed descriptions of known devices, circuits, tools, techniques, and methods are omitted so as not to obscure the description of the present system. It should be expressly understood that the drawings are included for illustrative purposes and do not represent the entire scope of the present system. In the accompanying drawings, like reference numbers in different drawings may designate similar elements. The term and/or and formatives thereof should be understood to mean that only one or more of the recited elements may need to be suitably present (e.g., only one recited element is present, two of the recited elements may be present, etc., up to all of the recited elements may be present) in a system in accordance with the claims recitation and in accordance with one or more embodiments of the present system.

Figure 1:
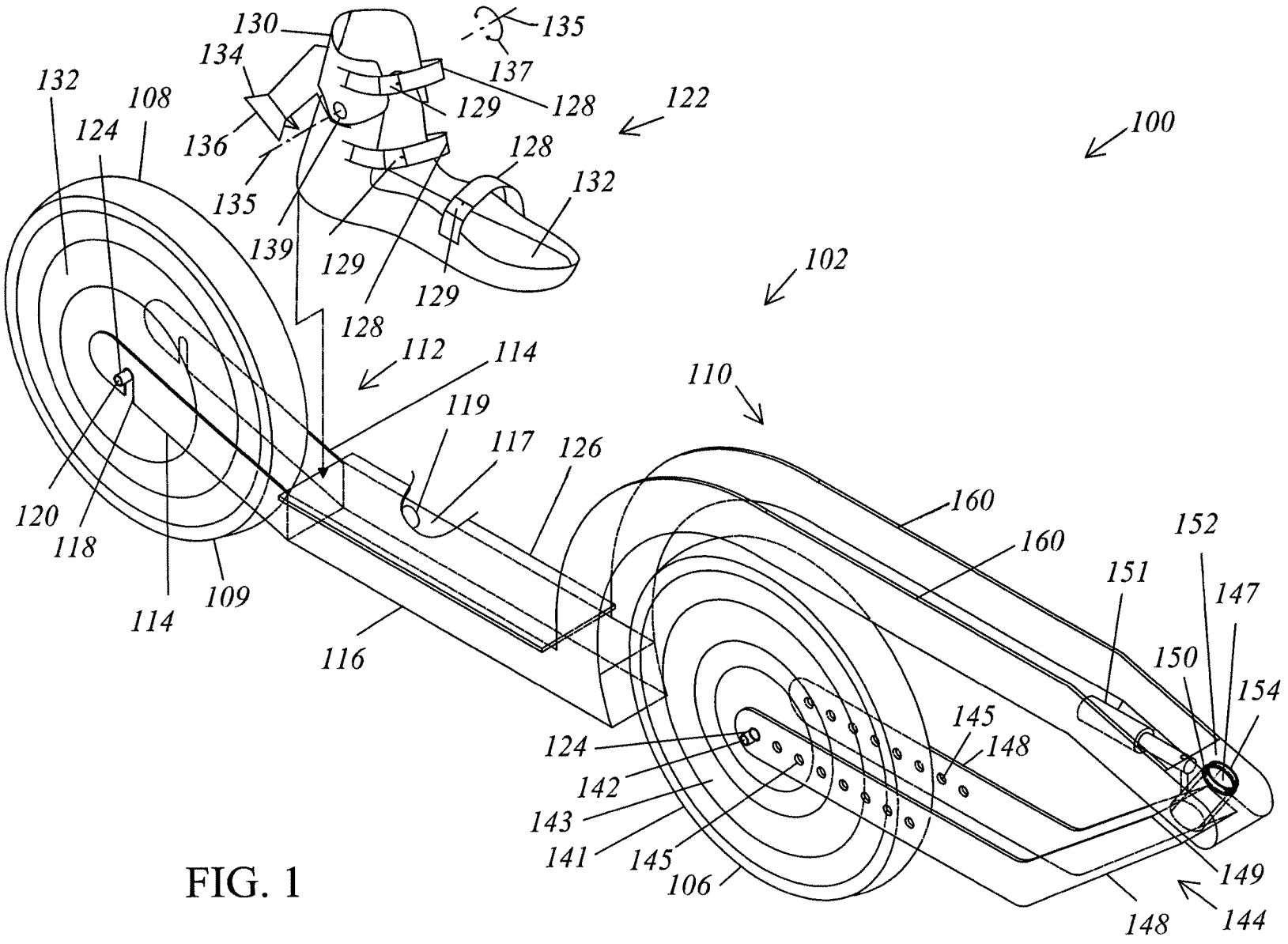
FIG. 1 is an illustration of an exploded perspective view of a portion of a motorized cross skate system in accordance with embodiments of the present system.

FIG. 1 is an illustration of an exploded perspective view of a portion of a motorized cross skate system 100 (hereinafter system) in accordance with embodiments of the present system. The system 100 may include two cross skates that may be substantially similar to each other. However, as each of the two cross skates may be substantially similar to each other, only a single cross skate 102 will be shown for the sake of clarity. The cross skate 102 may include a body 104 having a center section 116 and first and second extensions 110 and 112, respectively, extending therefrom configured to support the first and second wheels 106 and 108, respectively. The body 104 may include a platform 126 suitable for supporting a user situated at the center section 116. The perspective view of the other side may be similar.

The center section 116 may include a cavity 117 which may be shaped and sized or otherwise configured to receive a power source such as a battery pack 119. The cavity 117 may thus, at least partially enclose and provide physical protection for the power source. It is further envisioned that other types of power sources are also envisioned such as capacitors and/or the like. A controller may be situated within the cavity 117 and may be coupled to the power source so as to receive power from the power source. The power source may be removable for charging and/or replacement. A power port (e.g., a direct current (DC) port, an alternating current (AC) port, a USB port (e.g., USB-A, USB-C, etc.) and/or any other suitable port) may be coupled to the controller and may situated at any suitable location and may be configured to receive power from an external source (e.g., mains power, a direct current (DC) source, etc.) and may provide this received power to the controller. The controller may then charge the power source (e.g., the battery pack 119) and/or operate using this received power. The power port may be configured as a communication port and may couple to the controller. The cavity 117 may include one or more sub-cavities or compartments.

The second extension 112 may include rails 114 which may extend from the body 104 and around the second wheel 108 and may form a bifurcated rail set. However, it is also envisioned that the second extension 112 may be formed from a single rail (e.g., a mono-rail) which may extend from body 104 and be configured to be coupled to the second wheel 108. One or more of the rails 114 may include one or more axle supports such as openings, holes, slots, notches, slots, or dropouts 118 which may couple to an axle 120 of the second wheel 108. However, it is also envisioned that the axle supports may each include one or more openings which may be situated in each of the rails 114 and aligned with each other such that the axle 120 of the second wheel 108 may pass therethrough. The axle 120 may then be secured to the rails 114 using any suitable coupler such as an interference or friction type coupler (e.g., a cam-type coupler (e.g., a quick-release skewer), nuts 124, and/or the like) which may be tightened about the axle 120 so as to apply a force against one or more of the corresponding rails 114 so as to secure the axle 120 and second wheel 108 coupled thereto in position relative to the corresponding rails 114 and thus, the body 104. However, it is also envisioned that the axle may be attached to one or more of the rails 114 using any other suitable method or methods such as screw mounts, welds, bonds, rivets, and/or the like or may be formed integrally with one or more of the rails. For example, the second extension may include single rail which may form a mono-rail which may be coupled to an axle configured to couple to the second wheel 108 and which may extend from the single rail. The second wheel may be slid over and coupled to the axle which may be coupled to the single rail. Thus, a single-sided trailing or leading arm may be provided to support a corresponding wheel.

The second wheel 108 may form a second wheel 108 including the electric motor 132 (e.g., a hub motor, a traction motor, etc.), bearings (e.g., to provide for rotation of the second wheel 108 about the axle 120) the axle 120, and/or a tire 109. The tire 109 may include any suitable tire such as a solid tire, a foam tire, a pneumatic tire, and/or the like. The axle 120 may be hollow or solid. The axle 120 may include a cavity through which one or more wires (e.g., power, control, and/or sensor wires) may pass and be configured to couple one or more of the motor and/or sensors to a controller of the system. For example, the axle 120 may include a hollow axle through which the one or more wires may pass.

It is envisioned that the axle support may include one or more aligned openings, holes, slots, notches, slots, or dropouts 118 (although other suitable supports are also envisioned) which may be shaped and sized to receive the axle 120 of the second wheel 108 and may be aligned with each other so as to align the wheel with a longitudinal axis of the cross skate 102. These aligned openings may form a grove which may extend in a desired direction such as substantially downward (relative to the ground when in use) so that the axle 120 may be inserted into and out of one or more of the aligned openings. Then, after the axle 120 is positioned in the aligned openings, a tightening device such as the nuts 124 may be tightened around the axle 120, securing the axle 120, and thus, the second wheel 108 in position relative to the corresponding rails 114 and the body 104. The groves of the openings may be pointed in a desired position such as substantially downward which may reduce the likelihood of the axle 120 separating from the corresponding rails in the event that axle is improperly secured to one or more of the corresponding rails. Notches or tabs such as a positive retention device may be provided to further reduce the likelihood of separation of the axle from the corresponding rails even when the axle is improperly secured to the rails.

A boot 122 suitable for positioning a corresponding foot of a user may be coupled to the body 104 and may rest upon the platform 126 or portions thereof. It is envisioned that one or more portions of the boot 122 may be formed integrally with one or more portions of the platform 126. For example, a sole plate 132 of the boot 122 may be formed integrally with the platform 126 if desired. The boot 122 may include a lower section 121 and an articulated section 130 which may be articulated to the lower section 121 at articulated joints 139. The articulated section 130 may include a braking assembly 134 including a brake pad 136 which may be configured to contact the tire 109 of the second wheel 108 so as to provide a braking force to slow the rotation of the second wheel 108 during use. Accordingly, the articulated section 130 may articulate relative to the lower section 121 and/or sole plate 132 about an axis 135 as illustrated by arrow 137 so that when rotated towards the second wheel 108, the brake pad 136 of the braking assembly 134 may contact the tire 109 of the second wheel 108 to provide a desired braking force.

A rotational sensor 133 (e.g., e.g., an encoder, optic sensor, etc.) may sense this rotation and generate rotation information which may be provided to a controller of the system using any suitable wired or wireless communication method(s). The controller may activate drive modes and/or a regenerative braking mode in accordance with the rotational information provided by the rotational sensor 133. For example, when the rotational sensor 133 provides rotational information that is in a range indicative of a user leaning forward, a controller may activate a drive mode in which it may control power to the motor 132 such that increased leaning in a forward direction by the user (as indicated by the rotational information) may increase power to the rear wheel 132 linearly or non-linearly in accordance with drive settings as may be set by the system and/or user and stored in a memory of the system for use by the controller. Conversely, for example, when the rotational sensor 133 provides rotational information that is in a range indicative of a user leaning backwards, a controller may activate a regenerative braking mode in which it may control power to the motor 132 such that increased leaning in a rearward direction by the user (as indicated by the rotational information) may increase a regenerative braking force to the rear wheel 132 linearly or non-linearly in accordance with drive settings as may be set by the system and/or user and stored in a memory of the system for use by the controller. Settings of the drive and/or regenerative braking mode may be set by the system and/or user and stored in a memory of the system.

Thus, the controller may activate a regenerative braking mode in accordance with the rotational information which may activate regenerative braking by the motor 132. The regenerative braking force due to rotation of the articulated section 130 relative to the lower section 121 may be linear or non-linear based upon system and/or user settings are may be set by the system and/or user and stored in a memory of the system. The controller may further determine speed of the rear wheel 108 or motor 132 and may apply the regenerative braking and drive modes in accordance with algorithms which may prevent unexpected or undesirable skidding or locking of the rear wheel 132 to provide traction control and/or anti-lock functionality.

The lower section 121 may extend from the sole plate 132 and/or may be formed separately from or integrally with the sole plate 132. In some embodiments, matched openings in the platform 126 and boot 122 may be provided for receiving a couplers such as rivets or bolts which may couple the boot 122 to the platform 126 if desired.

It is further envisioned that the body 104 may include a boot coupler to couple a boot 122 to the platform 126 such that the boot 122 may be secured to, and/or may be supported by, the platform 126. The boot coupler may be adjustable such that a position and/or orientation of the boot 122 may be varied relative to the platform 126 as may be desired by the user. For example, the sole plate 132 may include a plurality of openings through which one or more couplers such as, bolts, studs, and/or the like may extend to couple the sole plate 132 to the platform 126. The position and/or orientation of the boot 122 may be fixed and/or may be adjustably set relative to the sole plate 132 as may be desired. These fasteners may then extend through corresponding openings in the platform 126 and/or rails 114. In yet other embodiments it is envisioned that the boot coupler may be formed using an interference fit and/or a releasable latch assembly. The boots 122 may be specific for a right or left foot of a user or may be universal (e.g., may fit the right and/or left foot).

Each of the boots 122 may include any suitable boot such as an exoskeleton-type boot which may position and/or support a corresponding foot of a user. For example, the boots 122 may include an exoskeleton-type boot, a ski boot, and/or the like. In some embodiments, the boot 122 may receive, position, and/or support a corresponding shoe and/or boot worn by the user. However, in yet other embodiments, the boots 122 may position and/or support a corresponding foot of a user regardless of whether the user wears any other form of footwear or the lack thereof. A coupler such as straps 128 may be provided and may be configured to secure a corresponding foot and/or shoe of a user to the corresponding boot 122. The straps 128 may be adjustable and may include any suitable fastener 129 for adjusting a size of the straps 128 about a foot of a user such as a buckle fastener (e.g., a ratcheting buckle, a micro-ratcheting buckle, and/or the like). However, other types of fasteners are also envisioned and may include, for example, hook-and-loop fasteners (e.g., Velcro™), notched fasteners, friction fasteners, interference type fasteners, and/or the like. It is envisioned that each of the boots 122 may include a sock in which foot of a user may be inserted.

The second wheel 108 may be referred to as a rear wheel and may include the electric motor 132 which may be coupled to the second wheel and may be configured to provide traction force to rotate the rear wheel 108 relative to the body 104 under the control of the controller. The electric motor 132 may be used to solely provide a motive force to drive the cross skate and/or may provide an assistive motive force which may drive the cross skate when powered by a user to assist the user of the cross skate thus making locomotion faster, easier, and more fun. The electric motor 132 may include a hub motor whose output may drive the second wheel 108 directly, via force transmitting member (e.g., a belt, chain, etc.), and/or via a transmission. When mounted directly may reduce or entirely eliminate the need for components such as belts, and chains which may be cumbersome and increase cost, complexity, and noise output. The hub motor of each cross skate may be matched and may include a commercial off-the-shelf (COTS) hub motor and may include direct drive coupling or belt or chain drive. For example, in some embodiments, the hub motor may be coupled to a transmission which may include a belt, chain, or other energy transfer device which may be configured to transmit mechanical power from an output of the hub motor to the driven wheel (e.g., the second wheel 108). It is envisioned that the hub motor may be direct drive and/or may include a transmission, such as a planetary type transmission or the like through which power may be transmitted to the second wheel 108 as may be desired.

It is envisioned that the hub motor may include a brushless hub motor that may not require a commutator, as alternating current ensures that the torque does not reverse itself. However, it is envisioned that other types of hub motors such as those which may employ brushes and the like may be employed as desired. In some embodiments the hub motor may provide a regenerative braking force under the control of the controller. Excess power generated during regenerative braking may be stored in the battery or other power storage device or may be dissipated in one or more resistors which may be coupled to one or more heat sinks for cooling.

The first wheel 106 may include one or more of a rim 143 including a hub 140, an axle 142 which may extend through the hub 140, and a tire 141. Bearings may provide for rotation of the hub 140 about the axle 142 and may include any suitable bearing assembly such as a cone type bearing assembly, a sealed bearing assembly, solid bearings, and/or the like. The axle 142 may be threaded to receive nuts 124 which may be tightened about the axle 142 to secure the first wheel 106 to a fork 144 having at least one fork blade 148, a crown 149, and a steerer 147. It is envisioned that the fork 144 may be configured to have a desired amount of offset or rake and may include a single fork blade 148 if desired.

Each fork blade 148 may include one or more openings or notches (e.g., dropouts or fork ends) such as openings 145 which may be configured to receive or otherwise position the axle 142 of the front wheel 106. For example, the openings 145 may be situated apart from each other and along a portion of a corresponding fork blade 148 such that the front wheel 106 may be positioned at a plurality of locations each with different trail. However, as the openings 145 are positioned substantially along a horizontal portion of a corresponding one of the fork blades 148, changing a position of the front wheel relative to the openings 145 may change the trail of the front wheel with little or no change in caster angle of the front wheel 106. The front wheel 106 is shown in a position with the most trail. Moving the front wheel 106 closer to the steerer 147 may decrease trail. As the openings 145 are situated apart from each other along the corresponding fork blade 148, they may be referred to as indexed openings and the front wheel 106 may be indexed with regard to trail by moving it from one or more of the openings 145. It will be assumed that the openings on each of the fork blades 148 may be aligned with each other such that the front wheel 106 may be aligned relative to the fork during use. Although the openings 145 are illustrated as round openings, in some embodiments the openings 145 may include other suitable openings for coupling the front wheel 106 to the fork 144 such as ovals, notches, slots, dropouts, and/or the like as may be desired.

The first extension 110 may include one or more rails 160 which may extend from the body 104 and include a head tube support 152. The head tube support 152 may include one or more openings to receive and/or couple to the steerer 147. For example, the head tube support 152 may include a head tube 150 having an opening configured to receive the steerer 147. A suitable support and bearing assembly such as a headset assembly 154 including bearings may rotatably couple the steerer 147 to the head tube 150 and may include, for example, a threaded or threadless type headset assembly. Accordingly, the steerer 147 may be a threaded or threadless type steerer so as to correspond with the headset assembly 154 which may include a conventional headset assembly. The first extension 110 may include a head tube support 152 configured to couple to a portion of a caster wheel. One or more of the rails 160 may be coupled to each other by cross-braces to increase rigidity if desired. Similarly, one or more of the rails 114 may be coupled to each other by cross-braces to increase rigidity if desired.

In some embodiments, it is envisioned that the headset assembly may be configured to receive a conventional caster-type wheel assembly (e.g., a COTS caster wheel assembly such as a commercially available swivel caster assembly otherwise referred to as a caster wheel) having at least one wheel.

A steering damper or steering stabilizer, such as a rotary or telescopic damper 151, may be coupled to one or more portions of the first extension 110 and the fork 144 and may be configured to damp undesirable oscillation or other movement of the fork 144 during use. The steering damper may include dampers of any suitable type such as a linear or rotary types as may be desired and may be active or passive and may be controlled by a controller of the system or by the user. Thus, in some embodiments the steering damper may be passive or may be active and controlled by a controller of the system. Sensors such as a steering angle sensor, a compass, a magnetometer, an orientation sensor, an accelerometer, gyroscope, geomagnetic, ultrasonic sensors, and/or the like may be provided to sense corresponding parameters and form corresponding sensor information which may be provided to a controller of the system for further analysis which may be performed to determine how to control the steering damper. In some embodiments, the steering damper may include a magnetorheological fluid (MR or MRF) type damper which may be controlled by the controller (e.g., the controller may control the viscosity of the MR fluid). It is further envisioned that the steering damper may further include a biasing member (e.g., a gas spring, a hydraulic spring, a coil spring, a leaf spring, etc.) which may passively or actively control a rotation of the steerer 147 about a steering axis (STA).

In some embodiments, the steering damper may include an electronic actuator (e.g., a steering actuator) such as a motor (e.g., linear or rotary, etc.) or the like which may actively damp and/or control rotation of fork relative to the body 104 of the cross skate 102 so as to control steering angle. For example, the steering angle sensor may provide steering angle sensor information to the controller which information may then analyzed to determine whether the fork 144 is oscillating. In response to this determination, the controller may control the damper to damp the oscillations of the fork 144. For example, when an amplitude and/or frequency of the oscillation is greater than threshold amplitude and frequency values, the controller may control the steering damper to increase damping so as to reduce the severity of the oscillation of the fork 144.

In some embodiments, the controller may determine an orientation of the cross skate relative to the ground. For example, the sensors may sense orientation of one or more of the cross skates relative to the ground (e.g., using one or more ultrasound sensors, etc.) and may adjust steering angle accordingly. For example, in response to determining that both cross skates have rolled about their longitudinal axis (e.g., to the left indicative of a left turn), the controller may control the steering actuator to turn the front wheel to the left. The controller may obtain steering sensor information which may include information related to one or more of roll (e.g., by angle), speed (e.g., obtained from wheel speed or GPS sensors), acceleration (e.g., obtained from acceleration sensors), load (e.g., weight of rider), and/or steering angle, from a memory of the system. Then, the controller may control the steering actuator to control the steering angle accordingly.

Figure 2:
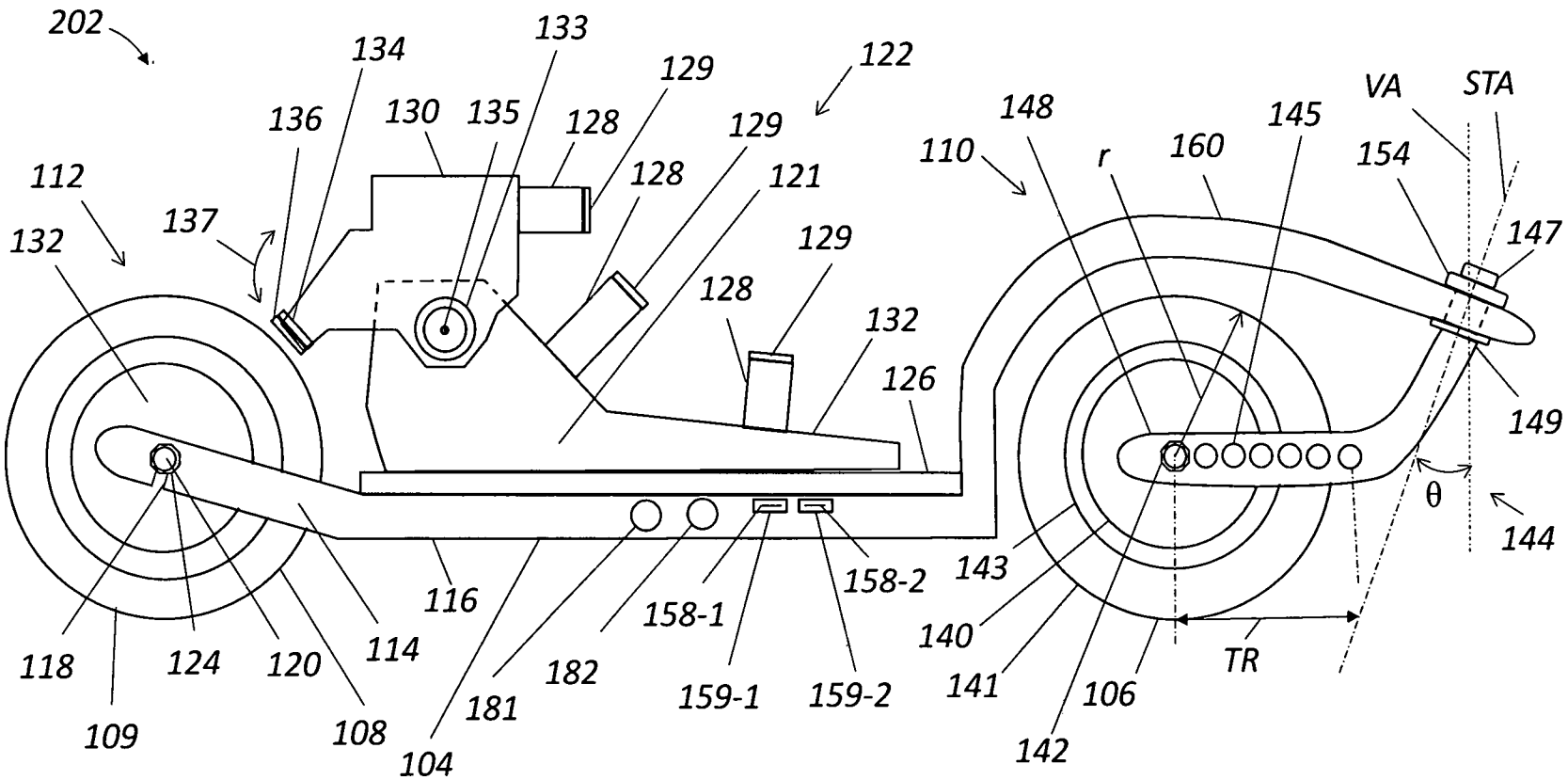
FIG. 2 is an illustration of a side view of a portion of a cross skate in accordance with embodiments of the present system.

FIG. 2 is an illustration of a side view of a portion of a cross skate 202 in accordance with embodiments of the present system. The cross skate 202 may be similar to the cross skate 102 of FIG. 1 and similar numerals are employed to denote the same or similar parts or portions thereof. For example, the cross skate 202 may include a body 104 having a center section 116 and first and second extensions 110 and 112, respectively. The other side view may be similar.

The fork 144 may be coupled to the first extension 110 and may include a plurality openings 145 for positioning the first wheel 106 relative to the fork 144. Trail (TR) of the first wheel 106 may be defined as a difference between a point of intersection of the STA with the ground and point of intersection of the first wheel 106 and the ground. The trail (TR) of the first wheel 106 may be modified by changing positioning of the first wheel 106 relative to the fork 144 by repositioning the axle 142 relative to one or more of the openings 145. Moving the first wheel 106 towards the steerer 147 may decrease the trail. The steerer 147 may rotate about and define the steering axis (STA) which may be positioned at an angle theta (θ) relative to a vertical axis VA. In some embodiments the angle θ may be less than thirty degrees. However, in yet other embodiments, the angle θ may be greater than thirty degrees. In accordance with some embodiments, the openings 145 may extend along a length of a corresponding fork blade 148 which may be greater than or equal to a radius r of the first wheel 106. In yet other embodiments, the openings 145 may extend along a length of a corresponding fork blade 148 which may be less than or equal to a radius r of the first wheel 106. One or more ports 158-1 and 158-2 may be coupled to the controller and may be accessible through corresponding openings 159-1 and 159-2, respectively, in the body 116. It is envisioned that the platform 126 may be flat (as shown) or may include a raised portion to couple to a heel of the boot 122. In some embodiments, a releasable coupler such as a ski-boot coupler may be provided to releasable couple the boot 122 to the platform 126 and may be configured to release the boot 122 when a threshold force is encountered. The threshold force may be set by a user. In some embodiments, the releasable coupler may include a mechanical or electromagnetic coupler one or more of which may be controlled by a controller of the system.

One or more sensors such as proximity sensors 181 may include any suitable sensor which may detect an adjacent cross skate operated by the user and may form corresponding proximity sensor information which may then be transmitted to the controller of the system. The sensors may also detect parameters such as one or more of roll, acceleration, speed, orientation, etc. and form corresponding sensor information which may then be provided to the controller. Then, using the obtained sensor information, the controller may then determine information related to each of the cross skates such as one or more of roll, acceleration, speed, distance and/or orientation of each of the cross skates of the adjacent cross skate using any suitable method such as triangulation techniques, etc. Then, using information such as one or more of the determined distance, orientation, speed, roll, etc., the controller may then determine a desired location, speed, and/or orientation of one or more of the cross skates relative to the other in accordance with a dynamics information stored in a memory of the system. Then, the controller may control one or more motors (e.g., 132) to adjust speed of the corresponding cross skates accordingly. It is also envisioned that the controller may control actuators to control dampers to adjust damping to control steering oscillation. In some embodiments, it is envisioned that the controller may control one or more actuators to control steering angle in accordance with roll, orientation, and/or speed information obtained from sensors of the system. This may reduce the need for a user to lift a cross skate to adjust its orientation.

Figure 3:
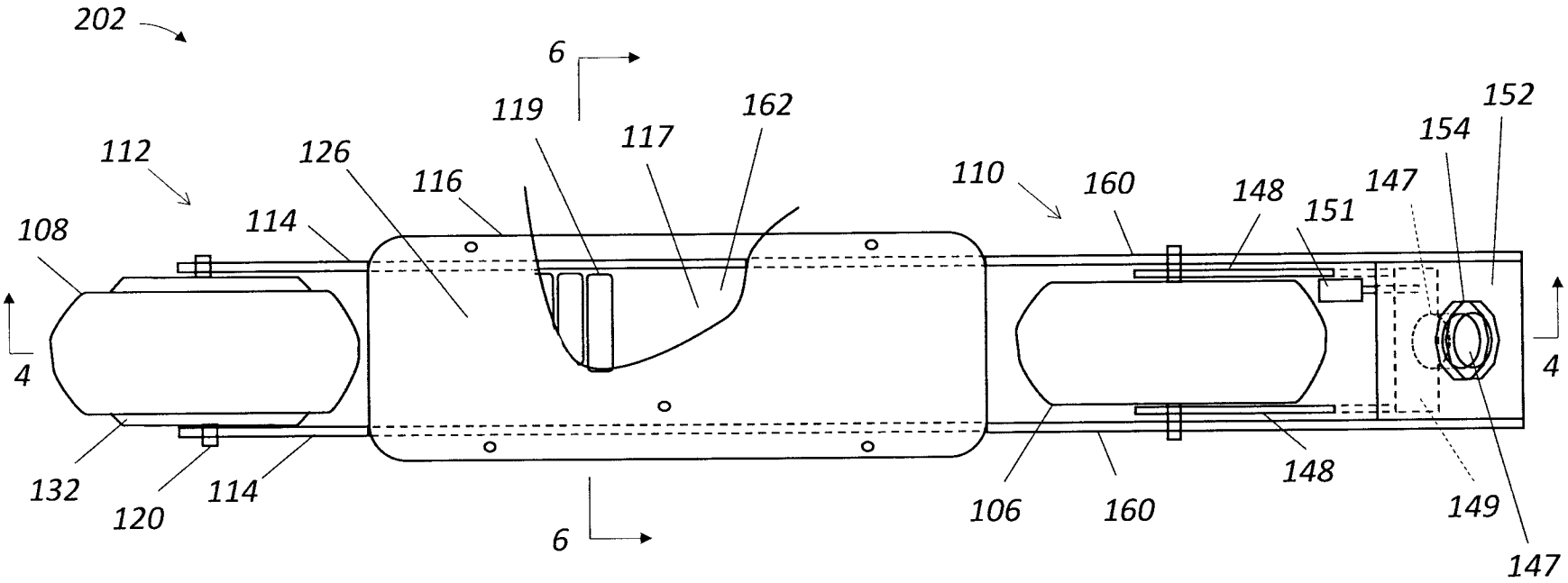
FIG. 3 is an illustration of a partially cutaway top view of a portion of the cross skate of FIG. 2 in accordance with embodiments of the present system.

FIG. 3 is an illustration of a partially cutaway top view of a portion of the cross skate 202 of FIG. 2 in accordance with embodiments of the present system. A portion of the platform 126 is cutaway to illustrate the cavity 117 and at least one battery pack 119 contained therein. The battery pack 119 may include one or more battery cells or capacitors. The boot 122 is not shown for the sake of clarity. A bottom panel 162 may define at least a portion of the cavity 117.

Figure 4:
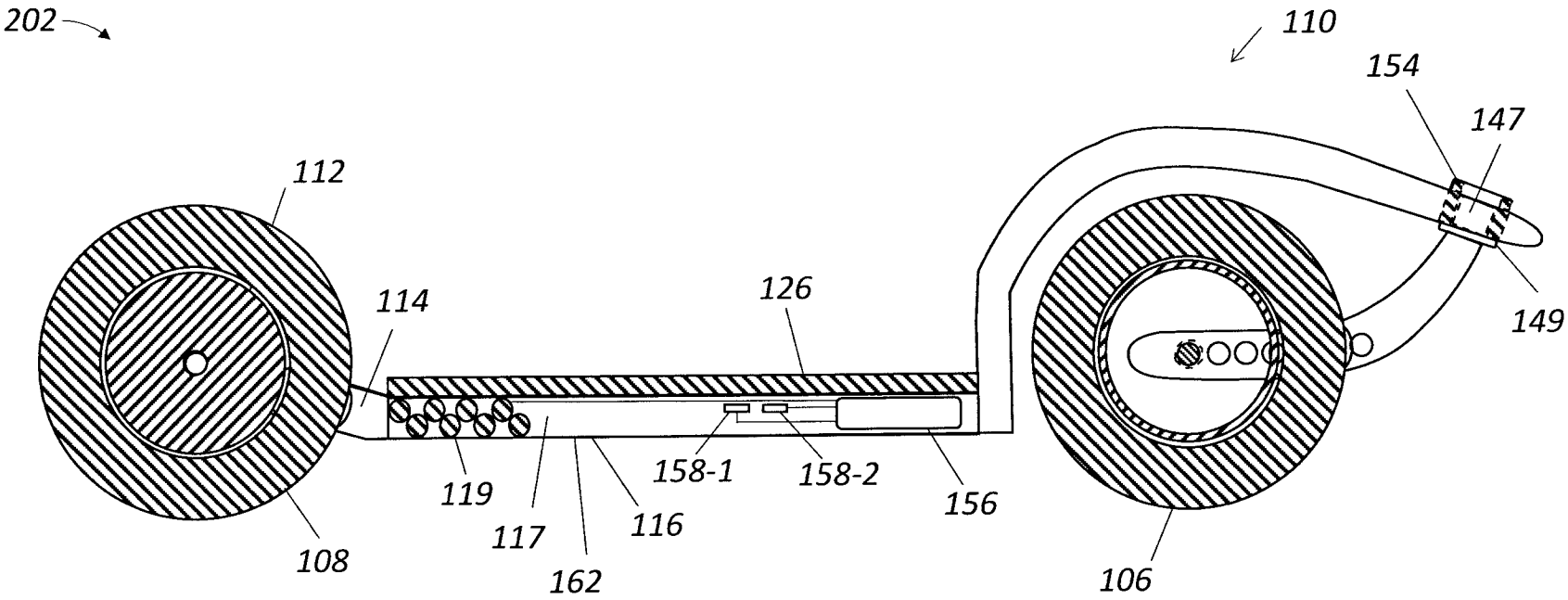
FIG. 4 is an illustration of a cross sectional view of a portion of the cross skate taken along lines 4-4 of FIG. 3 in accordance with embodiments of the present system.

FIG. 4 is an illustration of a cross sectional view of a portion of the cross skate 202 taken along lines 4-4 of FIG. 3 in accordance with embodiments of the present system. The battery pack 119 may be situated within the cavity 117 of the body 116 and may be coupled to a controller 156. The one or more ports 158-1 and 158-2 may be coupled to the controller 156 and may be accessible through corresponding openings 159-1 and 159-2 (see FIG. 2), respectively, in the body 116. The ports 158-1 and 158-2 may include ports for communication, power, displays, and/or switches. For example, the port 158-1 may be a charge port and communication port (e.g., USB-C, etc.) and port 158-2 may include a status indicator (e.g., a light source or display which may indicate a status (e.g., on, off, standby, charging, etc.) of the corresponding cross skate 102. One or more of the ports may include a switch function to turn on or off the cross skate 102 and/or to unlock or lock the cross skate 102. One or more portions of the center section 116 may be boxed to form the cavity 117. At least a portion of the cavity 117 may be formed from one or more of the center section 116, the platform 126, the bottom panel 162, and front and rear panels. Some cross hatching may be omitted for the sake of clarity.

Figure 5:
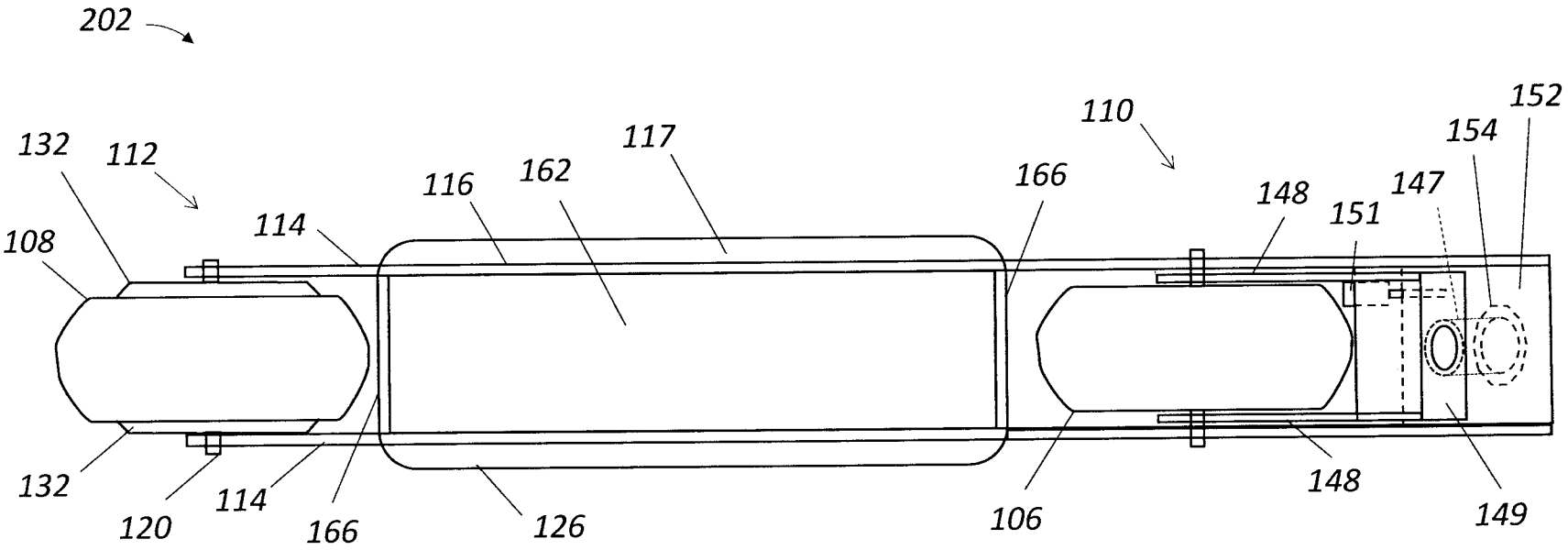
FIG. 5 is an illustration of a bottom view of a portion of the cross skate of FIG. 2 in accordance with embodiments of the present system.

FIG. 5 is an illustration of a bottom view of a portion of the cross skate 202 of FIG. 2 in accordance with embodiments of the present system. At least a portion of the cavity 117 may be formed from portions of one or more of the center section 116, the platform 126, the bottom panel 162, a front panel 164, and a rear panel 166.

Figure 6:
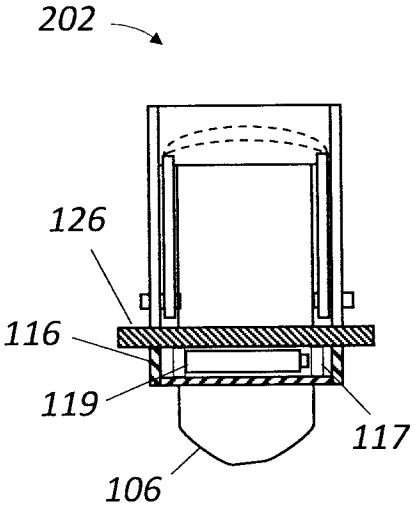
FIG. 6 is an illustration of a cross sectional view of a portion of the cross skate taken along lines 6-6 of FIG. 3 in accordance with embodiments of the present system.

FIG. 6 is an illustration of a cross sectional view of a portion of the cross skate 202 taken along lines 6-6 of FIG. 3 in accordance with embodiments of the present system. The battery pack 119 may be situated within the cavity 117 of the body 116. The platform 126 may be removably coupled to the body 116 and may be removed to access the cavity 117 and contents thereof such as the battery pack 119.

Figure 7B:
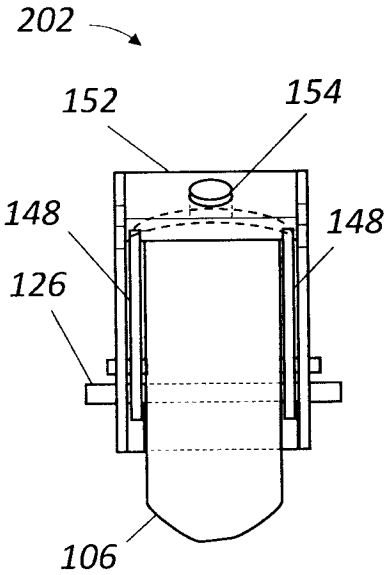
FIG. 7B is an illustration of a front view of a portion of the cross skate of FIG. 2 in accordance with embodiments of the present system.
Figure 7A:
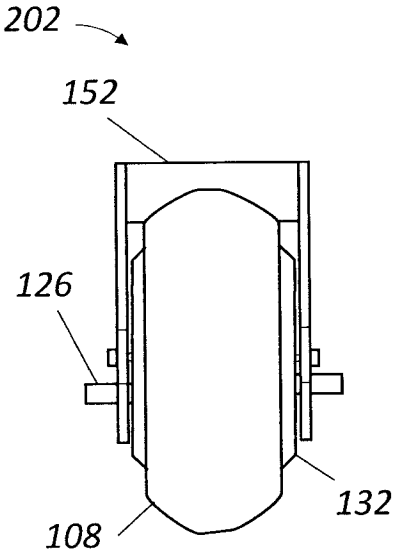
FIG. 7A is an illustration of a rear view of a portion of the cross skate of FIG. 2 in accordance with embodiments of the present system.

FIG. 7A is an illustration of a rear view of a portion of the cross skate 202 of FIG. 2 in accordance with embodiments of the present system.

FIG. 7B is an illustration of a front view of a portion of the cross skate 202 of FIG. 2 in accordance with embodiments of the present system.

Figure 8:
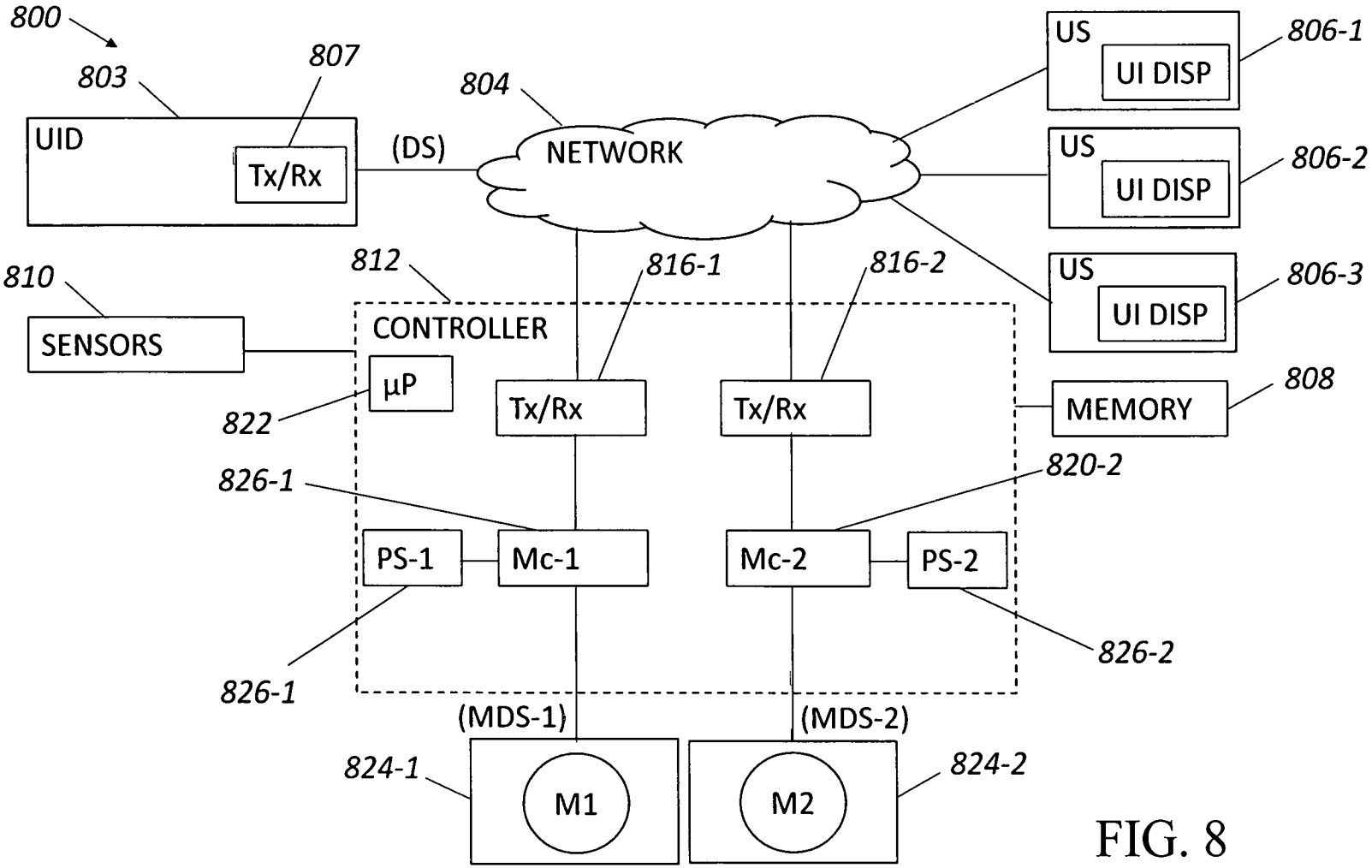
FIG. 8 is an illustration of a schematic diagram illustrating a portion of a cross skate system in accordance with embodiments of the present system.

FIG. 8 is an illustration of a schematic diagram illustrating a portion of a cross skate system (hereinafter system 800) in accordance with embodiments of the present system. The system 800 may include one or more of a controller 812, a network 804, one or more user stations (USs) 806-1 through 806-N (generally US-x), a memory 808, a user interface device (UID) 803, sensors 810, and first and second drive motors 824-1 and 824-2 (generally 824-*x*), respectively.

The controller 812 may control the overall operation of the system 800 and may include one or more transmitters and/or receivers (Tx/Rx) 816-1 and 816-2 (generally 816-*x*) that may communicate with the network 804. The controller 812 may include one or more logic devices such as one or more microprocessors (μP) 822 or the like that may be local or be distributed throughout the system 800. The first and second Tx/Rxs 816-1 and 816-2, respectively, may transmit information to and/or receive information from the UID 803 and/or one or more of the USs 806-*x*. This information may include information such as user settings, control information such as a drive signal, parameters, etc., that may be transmitted from the UID 803 to the controller 812. For example, the UID 803 may generate a drive signal (DS) in response to a user input detected by a sensor of the UID 803 (e.g., a force upon a trigger or twist lever of the UID 803). The Tx/Rx 807 of the UID 803 may then transmit the DS to the Tx/Rx 816-*x* of the controller 812. The controller 812 may then provide (synchronously or substantially synchronously) the received DS to first and second motor controllers MC-1 820-1 and MC-2 820-2, respectively, (generally MC-x 820-*x*).

The MCs 820-*x* may then process the received DS and generate corresponding first and second motor drive signals (MDS-1 and MDS-2), respectively, (generally MDS-xs) and provide the MDS-s to corresponding first and second motors 824-1 and 824-2, respectively. The first and second motors 824-*x* may then provide a corresponding force to a wheel attached thereto such as a regenerative braking force, a drive force, etc., which force may be operative to drive, accelerate, and/or brake, the corresponding wheel. The first motors 824-1 (M1) may be coupled to a first cross skate and the second motor second motor 824-2 (M2) may be coupled to a second cross skate. The MDS-xs may include a regenerative braking signal and/or a power signal for regenerative braking or power modes.

When a regenerative braking mode is active, the MCs 820-*x* may be configured to control the first and second motors 824-*x* to generate electrical power and this power may be provided to the corresponding first and second power supplies (PS-1) 826-1 and (PS-2) 826-2, respectively, (generally PS-x) to be stored for later use. The power supplies (PS-x) may include any suitable power storage device such as batteries, capacitors, etc. Sensors may determine power used by, or generated by, the first and second motors 824-*x* (M1 and M2) and may provide an indication of the power generated and/or used by the corresponding motors 824-*x* to the microprocessor 822. This information may then be rendered on a display of the system in, for example, real time, for the convenience of the user. In some embodiments, the controller 812 may include a battery charge controller which may determine how much charge each of the PS-xs may safely receive for charging and may sink excess power in one or more resistors. Heat sinks may be provided to dissipate excess heat from the heat sink. In some embodiments, portions of a corresponding cross skate such as a center section 116 may be coupled to and/or dissipate a thermal load from the one or more resistors.

The network 804 may include any suitable network such as a wired or wireless network (e.g., a near field communication (NFC) network, a Bluetooth™ type network, a WiFi™ network, a mobile network (e.g., 4G™ or 5G™, etc.), a system bus, etc.) through which information generated by, or received by, the system may be transmitted and/or received.

The UID 803 may include a transmitter and/or receiver (Tx/Rx) 807 and at least one user interface sensor such as a trigger a twist grip, a microphone, a camera, with which a user may interact, and which may sense an input of the user (e.g., a drive request, etc.). The UID may then generate a drive signal (DS) corresponding to the sensed input of the user, and/or may transmit this DS to the controller 812 using any suitable method such as a wired or wireless communication methods. For example, the UID 803 may transmit a wireless control signal including the DS which may be received by the controller 812. The UID 803 may include one or more logic devices such as one or more microprocessors or the like which may receive an input from a user, form a corresponding signal, and transmit this signal to the controller 812. The UID 803 may include a trigger type interface with which a user may interact to synchronously or sequentially control one or more of the motors 824-1. Accordingly, the UID 803 may sense a position of the trigger type interface and generate a corresponding drive signal which may then be transmitted to the controller 812. In some embodiments, a passive sensor system may be employed (e.g., a haptic sensor system, position sensors, lean sensors, etc.) to determine a drive request of the user and form or otherwise modify the DS accordingly.

In some embodiments a controller of the system may detect when a user has fallen off or is no longer riding the cross skate pair and may, in response, may be operative to brake, slow or stop the corresponding cross skate pairs.

It is also envisioned that a pressure or rotational sensor may be mounted to a boot and may sense pressure exerted by a foot of the user on the boot and form a corresponding signal pressure signal (PS) which may be provided to the controller 812 for further analysis. For example, the PS may be analyzed by the controller which may then modify a drive signal accordingly, to enhance user balance when riding the cross skate pair.

The USs 806-*x* may include any suitable mobile station such as a smart phone (e.g., an iPhone™, etc.), a tablet (e.g., an iPad™, etc.), a laptop, and/or the like with which a user may interact with the system. For example, the USs 806-*x* may receive a drive request from the user and transmit this request to the controller 812 via the network 804. In some embodiments, the USs 806-*x* may be configured to determine one or more gestures of the user and may generate a corresponding drive request.

The memory 808 may include a non-volatile memory which may be local or distributed throughout the system and may store applications, information generated by the system, user information, system settings, firmware, and/or one or more operating instructions of the system.

The sensors 810 may include one or more sensors which may sense parameters of the system, such as temperature (e.g., battery temperature, ambient temperature, etc.), humidity, current, voltage, speed, location, orientation (e.g., using magnetic field antennas, etc.), proximity, operating states (e.g., on, off, standby, in use, etc.), optical sensors ((e.g., to sense proximity), such as infrared sensors, optical sensors, etc.), radar or lidar sensors (e.g., to sense proximity, etc.), and ultrasonic sensors, and/or may form corresponding sensor information, and provide this sensor information to the controller 812 for further analysis in accordance with embodiments of the present system. The sensors 810 may be local and/or distributed throughout the system 800. For example, the sensors 810 may detect wheel speed (e.g., using a position sensor, etc.) of each driven wheel of the system and provide this information to a controller of the system which may then render this information on a display screen of the system for the convenience of the user. The controller may further adjust the speed of one or more of the motors 824-*x* based at least in part upon the determined speed, orientation (e.g., of a pair of cross skates of the system relative to each other), and user input. The Tx/Rxs 816-*x* may establish a bidirectional communication with other portions of the system such as one or more of the USs 806-*x*, the UID 803, etc. to provide information indicative of sensed parameters of the system (e.g., corresponding battery charge, current use, motor speed) and/or status (e.g., on, off, standby, in use, etc.). This information may then be rendered on a user interface of the system such as a display, a speaker, a haptic device, etc., for the convenience of the user.

It is envisioned that in some embodiments, the controller may be operative to engage one or more mechanical brakes to slow corresponding wheels of the cross skate pair.

It is envisioned that the controller 812 may synchronously control the motors 824-*x* so as to synchronize the speed of the cross skates driven by the motors 824-*x* relative to each other.

Figure 9:
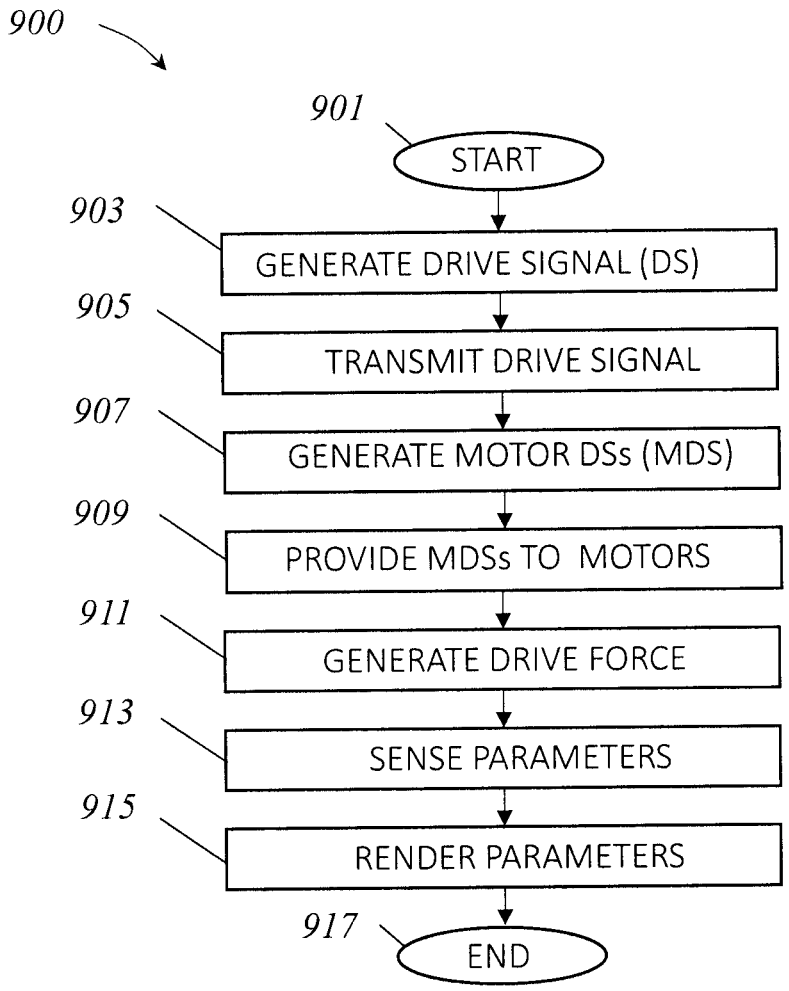
FIG. 9 is an illustration which shows a functional flow diagram performed by a process in accordance with embodiments of the present system.

FIG. 9 is an illustration which shows a functional flow diagram performed by a process 900 in accordance with embodiments of the present system. The process 900 may be performed using one or more processors, computers, controllers, etc., communicating over a network and may obtain information from, and/or store information to one or more memories which may be local and/or remote from each other. The process 900 may include one of more of the following acts. In accordance with embodiments of the present system, the acts of process 900 may be performed using a controller operating in accordance with embodiments of the present system. Further, one or more of these acts may be combined and/or separated into sub-acts, as desired. Further, one or more of these acts may be skipped depending upon settings. For the sake of clarity, the process may be described with reference to a single cross skate. However, without limitation, it should be understood that the process may employ a plurality of cross skates each of which may include a separate workflow such as a sub-workflow. In operation, the process may start during act 901 and then proceed to act 903.

During act 903, a UID of the system may generate a drive signal (DS) in response to a signal generated by a sensor in response to an input from a user of the system. In accordance with embodiments of the present system, the DS may be generated in response to movement or pressure upon a UI of the system such as a trigger or twist grip, etc. that may be exerted by a user of the system. After completing act 903, the process may continue to act 905.

During act 905, the UID may be operative to control its transmitter (or Tx/Rx) to transmit the generated DS to receivers (or Tx/Rxs) of first and second cross skates which may form a cross skate pair. After completing act 905, the process may continue to act 907.

During act 907, receivers of the cross skate pair may each receive the transmitted DS and provide these signals to corresponding MCs that may then process the received DS and generate a corresponding motor drive signals (MDSs). After completing act 907, the process may continue to act 909.

During act 909, the respective MDSs may be provided to the corresponding traction motor (e.g., hub motor) of each cross skate of the cross skate pair. In some embodiments of the present system, the control signals such as the DS and MDs may be configured so that the traction motors may be synchronized with each other or otherwise controlled so that a traction motor of the traction motors may drive a corresponding cross skate at a speed determined by a controller of the system. This may enhance user experience during use of the cross skate pair operating in accordance with embodiments of the present system. After competing act 909, the process may continue to act 911.

During act 911, the traction motors may receive the corresponding MDS and may generate a tractive force (e.g., a drive force) in response thereto to drive a corresponding wheel of the cross skate pair or to slow the corresponding wheel of the cross skate pair using a regenerative braking. Accordingly, each of the MDS may be configured to operate a corresponding traction motor in a drive or regenerative braking modes. After completing act 911, the process may continue to act 913.

During act 913, sensors of the system may sense system parameters such as speed, voltage, current, battery charge, roll, steering angle, etc., and may provide this information to a controller of the system for further processing. Thereafter, the controller may generate and/or modify one or more signals of the system (e.g., DS, MDS, etc.) in accordance with the sensor input. After completing act 913, the system may continue to act 915.

During act 915, the process may configure a controller of the system to obtain and/or render one or more of the sensed parameters on a user interface (UI) of the system such as a display, a speaker, and/or a haptic device. During this act the system may render a user interface such as menu options which may be selected by a user to set or otherwise adjust a desired parameter of the system. An option to synchronize the motors of each of the cross skate pair may also be rendered for selection by a user. If selected, the process may then synchronize each of the motors of the cross skate pair such that each cross skate may operate substantially at the same speed as the other so as to prevent undesirable yaw of the user and reduce any strain on the user. This may enhance user convenience and comfort. After completing act 915, the process may continue to act 917 where it may end.

Figure 10:
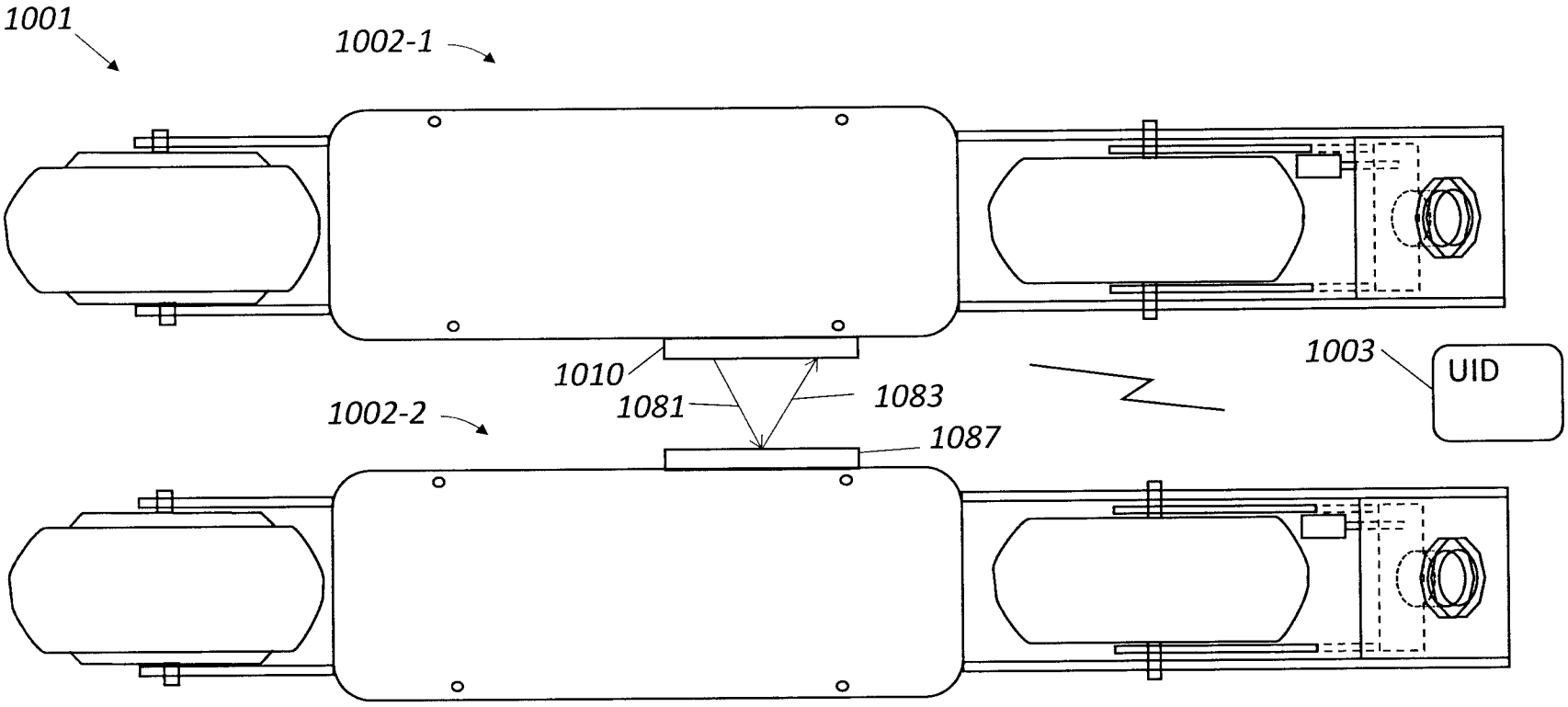
FIG. 10 is an illustration which shows a top view of a cross skate pair and a trigger type UID in accordance with embodiments of the present system.
Figure 11:
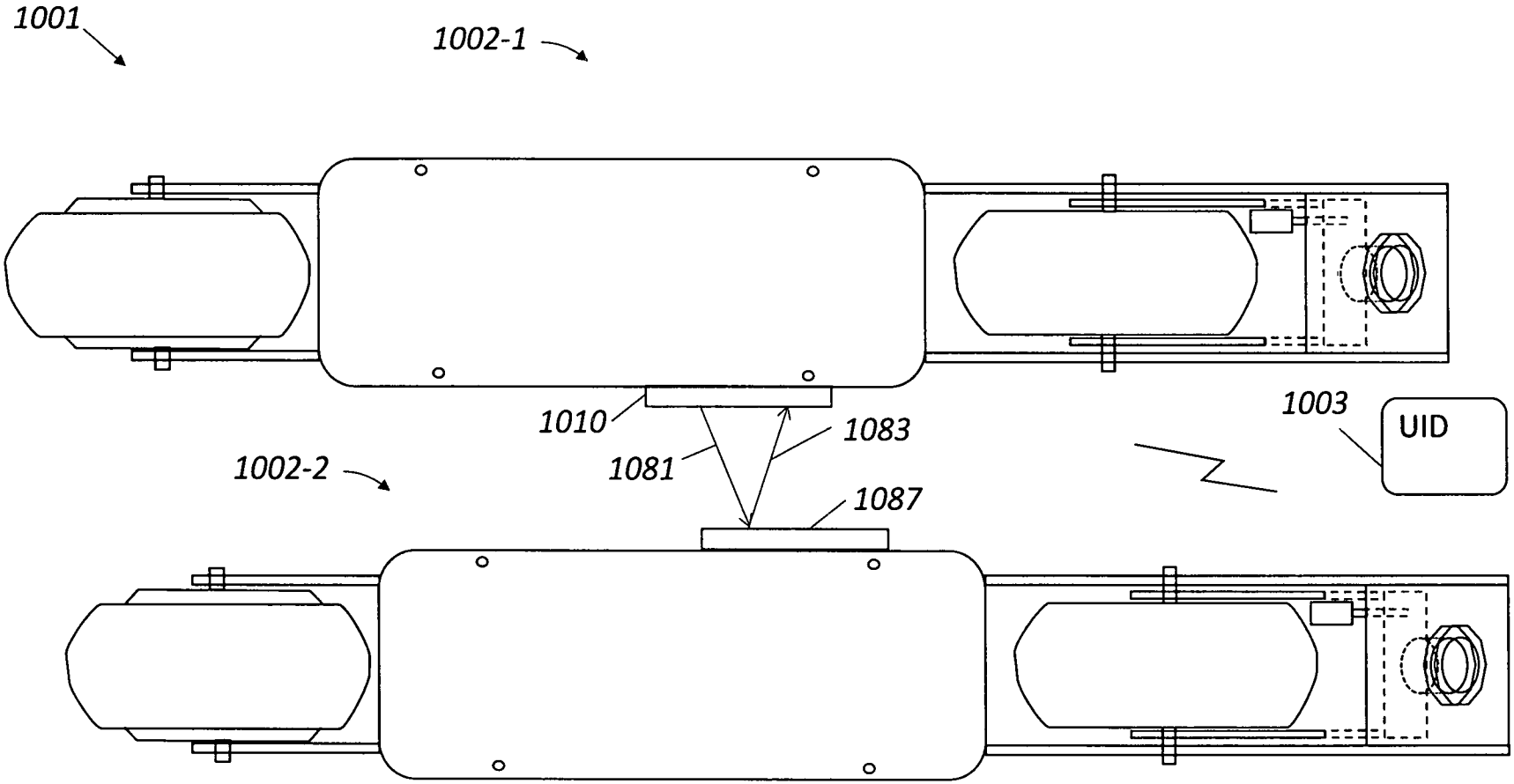
FIG. 11 is an illustration which shows a top view of a cross skate pair and a trigger type UID in accordance with embodiments of the present system.

FIG. 10 is an illustration which shows a top view of a cross skate pair 1001 and a trigger type UID 1003 in accordance with embodiments of the present system; and FIG. 11 is an illustration which shows a top view of a cross skate pair 1001 and a trigger type UID 1003 in accordance with embodiments of the present system.

With reference to FIG. 10, the cross skate pair 1001 may include first and second cross skates 1002-1 and 1002-2 which may synchronously and/or concurrently react to a drive control signal of the trigger type UID 1003 so as to prevent undesirable yaw of a user during use. The system may provide a user interface with which a user may balance the system such that each of the cross skates 1002-1 and 1002-2 may be operative at equal speeds and/or may be operative to provide desired acceleration or deceleration which may be equally provided by each cross skate 1002-1 and 1002-2 of the cross skate pair 1002-1 and 1002-2. For example, sensor information of the system may be obtained and analyzed by the system and a motor drive signal for each of the cross skates 1002-1 and 1002-2 of the cross skate pair 1002-1 and 1002-2 may be balanced to provide a desired yaw or reduce or entirely prevent yaw of the user due to a cross skate leading or lagging. The UID 1003 may be programmed in accordance with embodiments of the present system.

Embodiments of the present system may employ a single handheld transmitter (e.g., a handheld remote or UID) which may be operative to sequentially control a cross skate pair (e.g., two cross skates) using a receiver on each cross skate which may be configured to be controlled by the same handheld transmitter wirelessly. Each of these receivers may be attached to an electronic speed controller which may be operative to uniformly control the speed across both cross skates with a single handheld remote. To configure two receivers to the single handheld transmitter, each receiver may be synchronized (e.g., synced) with the single handheld transmitter. After both receivers are synced, the single handheld transmitter may be operative to control both receivers and attached motors.

In some embodiments, at least one sensor such as an optical transducer 1010 may sense a position of a cross skate relative to the other of the cross skate pair and form corresponding relative location information (RLI) For example, the optical transducer 1010 on the first cross skate 1002-1 may transmit a signal 1081 which may be reflected off of a reflective surface (or pattern) 1087 at a known location on the second cross skate 1002-2 and may form a part of a returned signal 1083 that may be received by the transducer 1010 of the first cross skate 1002-1. This received signal may then be analyzed by a controller of the system to generate the RLI which may be analyzed to determine a position of the cross skates 1002-1 and 1002-2 relative to each other. For example, a controller of the system may analyze the received signal using any suitable method or methods (e.g., triangulation methods, etc.) to determine a position and/or orientation of the second cross skate 1002-2 relative to the first cross skate 1002-1. In the present embodiments it will be assumed that the first and second cross skates 1002-1 and 1002-2 are orientated in the same direction along a longitudinal axis (e.g., in parallel) as shown for the sake of clarity. The controller may then determine whether the second cross skate 1002-2 is substantially in line with the first cross skate 1002-1 (longitudinally) (as shown in FIG. 10) or may be leading or lagging relative to the first cross skate 1002-1 (e.g., as shown in FIG. 11 where the second cross skate 1002-2 is leading relative to the first cross skate 1002-1). In response to a determination that the second cross skate 1002-2 is substantially in line with the first cross skate 1002-1 (longitudinally), the controller may continue to provide a drive signal to drive each of the cross skates 1002-1 and 1002-2 at equal speeds. However, in response to a determination that the second cross skate 1002-2 is lagging relative to the first cross skate 1002-1 (longitudinally), the controller may modify a drive signal to drive the second cross skate 1002-2 at a faster speed (e.g., or percent of speed) relative to the first cross skate 1002-1 so as to bring the second cross skate 1002-2 substantially in line with the first cross skate 1002-1 (longitudinally) and may modify a drive signal to drive the first cross skate 1002-1 at a slower speed (e.g., or percent of speed) relative to the second cross skate 1002-2 so as to slow it down to bring the first and second cross skates 1002-1, 1002-2 substantially in line with each other.

One or both of the motors may be driven at slower of faster speeds to bring the cross skates in line with each other. This may reduce or prevent yawing of the user and enhance a user experience. Accordingly, the motors may be differentially driven (e.g., speed up the lagging cross skate and slow the leading cross skate) or one or of the motors may be driven slower or faster to bring a desired cross skate in line relative to the other.

Figure 12:
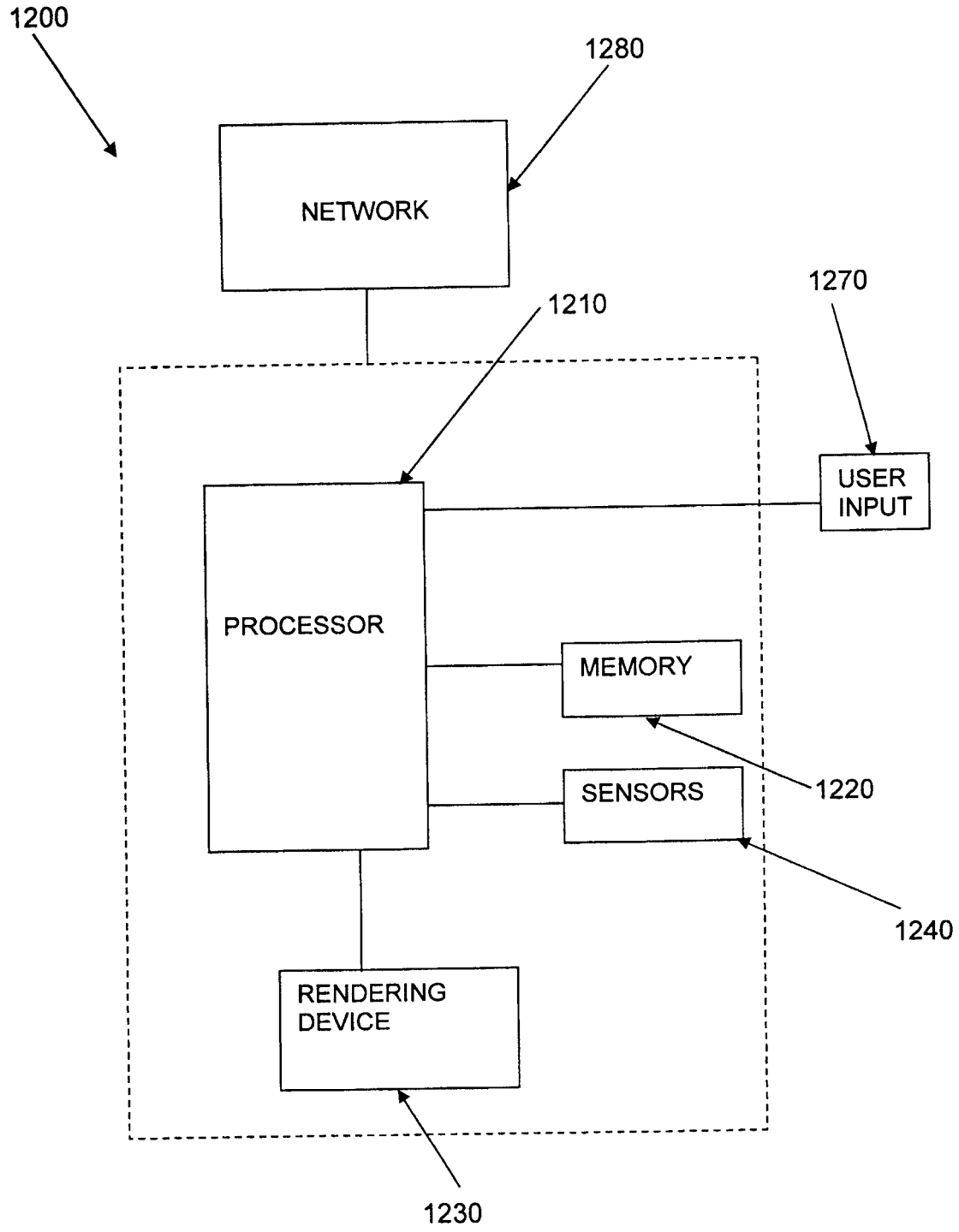
FIG. 12 is an illustration which shows a portion of a system in accordance with embodiments of the present system.

FIG. 12 is an illustration which shows a portion of a system 1200 in accordance with embodiments of the present system. For example, a portion of the present system may include a processor 1210 (e.g., a controller) operationally coupled to a memory 1220, a user interface (UI) including a rendering device such as a display 1230, sensors 1240, and a user input device 1270. The memory 1220 may include any type of device for storing application data as well as other data related to the described operation. The application data and other data may be received by the processor 1210 for configuring (e.g., programming) the processor 1210 to perform operation acts in accordance with the present system. The processor 1210 so configured becomes a special purpose machine particularly suited for performing in accordance with embodiments of the present system.

The operation acts may include configuring a system by, for example, a registration system in accordance with system settings.

The processor 1210 may control one or more synchronizing methods for synchronizing operation of a cross skate pair in accordance with sensory input. The processor 1210, thereof may process received signals such as sensor information, transform these signals to location signals, and may generate control signals to drive one or more of actuators and/or traction motors of the system accordingly. It is further envisioned that the processor may generate content which may include image information (e.g., still or video images (e.g., video information)), data, and/or graphs that may be rendered on, for example, a UI of the system such as on the display 1230, a speaker, a haptic device, etc. The content may include image information as may be generated by an imaging system of the present system. Further, the content may then be stored in a memory of the system such as the memory 1220 for later use. Thus, operation acts may include requesting, providing, and/or rendering of content. The processor 1210 may render the content such as video information on a UI of the system such as a display of the system. Content may include system parameters (e.g., speed, temperature, acceleration, deceleration, angle of climb, etc.), location information, time stamps, image information, etc. This content may be rendered on a user interface such as a display of the system for a user's review in real time (e.g., using an optical head mounted type display such as smart glasses or the like or after a ride (e.g., using a display of an US). In yet other embodiments, virtual reality and/or augmented reality systems and methods may be employed to render content generated by the system.

The user input 1270 may include a keyboard, a mouse, a trackball, a trigger controller, or other device, such as a touch-sensitive display, which may be stand alone or part of a system, such as part of a personal computer, a personal digital assistant (PDA), a mobile phone (e.g., a smart phone), a monitor, a smart or dumb terminal, smart glasses, smart watches, or other device for communicating with the processor 1210 via any operable link such as a wired and/or wireless communication link. The user input device 1270 may be operable for interacting with the processor 1210 including enabling interaction within a UI as described herein. Clearly the processor 1210, the memory 1220, display 1230, and/or user input device 1270 may all or partly be a portion of a computer system or other device such as a client and/or server.

The methods of the present system are particularly suited to be carried out by a computer software program, such program containing modules corresponding to one or more of the individual steps or acts described and/or envisioned by the present system. Such program may of course be embodied in a computer-readable medium, such as an integrated chip, a peripheral device or memory, such as the memory 1220 or other memory coupled to the processor 1210.

The program and/or program portions contained in the memory 1220 may configure the processor 1210 to implement the methods, operational acts, and functions disclosed herein. The memories may be distributed, for example between the clients and/or servers, or local, and the processor 1210, where additional processors may be provided, may also be distributed or may be singular. The memories may be implemented as electrical, magnetic, or optical memory, or any combination of these or other types of storage devices. Moreover, the term "memory" should be construed broadly enough to encompass any information able to be read from or written to an address in an addressable space accessible by the processor 1210. With this definition, information accessible through a network 1280 is still within the memory, for instance, because the processor 1210 may retrieve the information from the network 1280 for operation in accordance with embodiments of the present system.

The processor 1210 may be operable for providing control signals and/or performing operations in response to input signals from the user input device 1270 as well as in response to other devices of the network and executing instructions stored in the memory 1220. The processor 1210 may include one or more of a microprocessor, an application-specific or general-use integrated circuit(s), a logic device, etc. Further, the processor 1210 may be a dedicated processor for performing in accordance with the present system or may be a general-purpose processor wherein only one of many functions operates for performing in accordance with the present system. The processor 1210 may operate utilizing a program portion, multiple program segments, or may be a hardware device utilizing a dedicated or multi-purpose integrated circuit.

Further variations of the present system would readily occur to a person of ordinary skill in the art and are encompassed by the following claims.

Thus, in accordance with embodiments of the present system a cross skate body (CSB) of a cross skate pair may include a coupler to couple the front wheel to the CSB such that it may be passively steered when the CSB leans relative to the ground. This may be referred to as a passive steering coupler (PSC). The coupler may include any suitable coupler, such as a caster type coupler, which may form a caster type wheel configuration with the first wheel of the CSB. For example, when leaning, the passive steering coupler may deflect or otherwise induce steering of the front wheel such that the corresponding CSB may be steered in a direction corresponding to the lean of the CSB relative to the ground. Accordingly, a user may not have to lift the CSB in order to turn.

In accordance with some embodiments, it is envisioned that the PSC may include a damper (e.g., a passive or active damper) to damp steering movement to reduce or prevent steering oscillations such as caster flutter or the like. For example, the damper may include a passive friction or hydraulic type damper. However, in yet other embodiments, the damper may include an active type damper (e.g., an electroactive damper) that may be controlled by a controller of the system. For example, the damper may include a magneto magnetorheological damper or the like which may be controlled by the controller of the system. In some embodiments, a steering actuator may be provided to control steering of a front wheel under the control of a controller of the system.

In accordance with some embodiments, the swivel wheel, otherwise known as a caster wheel, may rotate around an axis perpendicular to the ground's surface. When the swivel wheel is mounted to so that its axis of rotation forms an angle to the road's normal, the swivel wheel and thus the entire CSB, may turn when the user leans the CSB relative to the ground. Swivel wheels are not known to be employed on cross skates.

In accordance with some embodiments, to mount the swivel wheel, a mounting portion of the cross skate such as the head tube must be angled backwards. In accordance with some embodiments, a swivel plate plater may be attached to swivel support of a cross skate. A swivel plate may include a rectangular piece of material which may include a rotating axle perpendicular to it. The axle, which rotates using casters, bearings, or other mechanisms to reduce friction, is then attached to a fork which houses the front wheel. Other ways to mount a swivel wheel include attaching a fork having a steerer tube to a head tube using a headset including bearings and then attaching the front wheel to the fork.

Embodiments of the present system may include an electronic speed controller (ESC) which may include a circuit which may control the transmission of speed and braking from an electric motor such as a (hub) motor of each driven wheel of a CSB. For example, the system may employ a Vedder Electronic Speed Controller (VESC) operating in accordance with embodiments of the present system, and may provide programmable parameters to the CSB. It is envisioned that operating parameters of a controller such as the VESC may be specific to embodiments of the present system.

For example, in some embodiments, it is envisioned that to adapt a VESC for specific motors of the present system, one or more parameters (e.g., 200 parameters) may be set in accordance with embodiments of the present system. For example, before starting, BLDC (BrushLess Direct Current) or FOC (Field Oriented Control) modes may be selected and/or set in accordance with the motors. Maximum and minimum voltages may be set, along with battery cutoffs to save the life of batteries which supply power to the corresponding motors. A parameter known as Start-Up Boost may be set to determine the initial acceleration of each motor. As two motors may be employed, it is desirable that these motors have similar operating characteristics to balance the system. Finding a desired boost setting may be dependent upon the preferences of a user and, as such, may require a balance between having the acceleration throw off the user or having the motor stall due to lack of power. To fully adapt the VESC, one has to center the throttle of the receiver, so each side of the controller may provide either 100% boost or 100% brake. Many other parameters may also be set and may be discussed elsewhere in this document.

In accordance with some embodiments, one or more portions of the controller of the present system may be situated within a cavity of body of a corresponding cross skate. This may ensure that electronics may be placed inside body of a cross skate and not subject to impacts, moisture, etc. Additionally, having electronics inside the frame may be beneficial to lower a center of gravity (c.g.) of a corresponding cross skate, and, thus, the cross skate system which may enhance stability as well as reaction. A multiplexed bus may be employed for communication to reduce wiring within a cross skate body as may be desired.

Embodiments of the present system may employ a single handheld transmitter (e.g., a handheld remote or UID) which may be operative to sequentially control a cross skate pair (e.g., two cross skates) using a receiver on each cross skate which may be configured to be controlled by the same handheld transmitter wirelessly. Each of these receivers may be attached to an electronic speed controller which may be operative to uniformly control the speed across both skates with a single handheld remote. To configure two receivers to the single handheld transmitter, each receiver may be synchronized (e.g., synced) with the single handheld transmitter. After both receivers are synced, the single handheld transmitter may be operative to control both receivers and attached motors.

Although a cross skate having a powered fixed rear wheel and an unpowered caster type front wheel has been disclosed, it is envisioned that in yet other embodiments, the front wheel may be powered by a motor. It is also envisioned that the rear wheel may include a swivel-type wheel.

Certain additional advantages and features of this invention may be apparent to those skilled in the art studying the disclosure, or may be experience by persons employing the novel system and method of the present invention, chief of which are providing a motorized cross skate system.

While the invention has been described with a limited number of embodiments, it will be appreciated that changes may be made without departing from the scope of the original claimed invention, and it is intended that all matter contained in the foregoing specification and drawings be taken as illustrative and not in an exclusive sense.

Accordingly, embodiments of the present system disclose a cross skate system and method in which an electric hub motor built for scooters may be used to power a corresponding wheel, such as a rear wheel of a cross skate combination. Portions of a control system for controlling the cross skate system may be located at one or more locations and, as such, may be distributed. For example, the cross skate electronics may be located at one or more locations inside the frame. These may include a modified electronic speed controller such as a Vedder Electronic Speed Controller (VESC) operating in accordance with embodiments of the present system which may control power distributed to or from one or more power sources of the system, such as from one or more battery packs, to or from one or more motors of each cross skate of a cross skate pair. A pair of motorized cross skates may be controlled by one or more handheld transmitters, which may transmit or otherwise provide signals to two receivers connected to two electric speed controllers. To turn the motorized cross skate, the user may lean in an intended direction, which causes an angle-mounted swivel front wheel to turn in said direction.

Accordingly, there is disclosed an electric motorized cross skate system which may include a motorized cross skate pair that may be powered by an electric hub motor originally built for scooters. The electric hub motor may be paired with a speed controller such as a Vedder Electronic Speed Controller (VESC) operating in accordance with embodiments of the present system. The power source may include one or more batteries and may be located inside one or more cavities of a corresponding cross skate frame. Similarly, electronics circuits operating in accordance with embodiments of the present system may be located in one or more cavities of a corresponding cross skate frame. It is envisioned that a single hand-held transmitter may control both power flow of the cross skates via a pair of receivers. The steering mechanism may include an angle-mounted swivel front wheel which may be employed to turn a corresponding cross skate by leaning.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. In addition, any section headings included herein are intended to facilitate a review but are not intended to limit the scope of the present system. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated;

i) the term "plurality of" an element includes two or more of the claimed element, and does not imply any particular range of number of elements; that is, a plurality of elements may be as few as two elements, and may include an immeasurable number of elements; and j) the term and/or and formatives thereof should be understood to mean that only one or more of the listed elements may need to be suitably present in the system in accordance with the claims recitation and in accordance with one or more embodiments of the present system.

What is claimed is:

1. A device comprising:

first and second cross skate bodies each having a frame configured to support at least first and second wheels situated inline of each other, each frame having at least one compartment configured to position a corresponding power source of first and second power sources and a steering damper configured to damp steering motion of the first wheels;

first and second foot couplers, each foot coupler configured to couple a foot of a user to a corresponding cross skate body of the cross skate bodies;

a first traction motor coupled to drive at least one of the first and second wheels of the first cross skate body;

a second traction motor coupled to drive at least one of the first and second wheels of the second cross skate body; and a controller configured to:

receive a drive signal from a drive controller, and control the first and second traction motors to drive the corresponding wheels in accordance with the drive signal; wherein the steering damper is actively controlled by the controller.

2. The device of claim 1, wherein the first and second traction motors comprise hub-type motors.

3. The device of claim 1, wherein the first and second traction motors are coupled to at least one of the first and second corresponding wheels with a belt or chain.

4. The device of claim 1, wherein the controller is configured to synchronously control the first and second traction motors.

5. The device of claim 1, wherein the compartment of each of the of the first and second cross skate bodies is configured to at least partially house a corresponding power source of the first and second power sources.

6. The device of claim 1, wherein the drive controller comprises a handheld transmitter which transmits a drive signal to synchronously control the first and second traction motors.

7. The device of claim 6, wherein the drive controller is configured to synchronously control the first and second traction motors to enter acceleration or regenerative braking modes.

8. The device of claim 7, further comprising first and second sensors configured to sense the speed of the first and second traction motors, respectively.

9. The device of claim 1, wherein each of the first and second cross skate bodies comprise a passive steering coupler for steerably coupling the first wheel to the corresponding cross skate body of the first and second cross skate bodies.

10. The device of claim 9, wherein the passive steering coupler forms a caster wheel.

11. The device of claim 10, wherein the steering damper is configured to damp steering oscillation.

12. The device of claim 1, wherein the first and second foot couplers each comprise straps, a boot, or a shoe.

13. A device comprising:

first and second cross skate bodies each having a frame configured to support at least first and second wheels situated inline of each other, each frame having at least one compartment configured to position a corresponding power source of first and second power sources;

a fork for supporting the first wheel of each of the skate bodies in a caster configuration;

a steering damper coupled to the fork;

first and second foot couplers, each foot coupler configured to couple a foot of a user to a corresponding cross skate body of the cross skate bodies;

a first traction motor coupled to drive at least the second wheel of the first cross skate body;

a second traction motor coupled to drive at least the second wheel of the second cross skate body; and a controller configured to:

receive a drive signal from a drive controller, and control the first and second traction motors to drive the corresponding wheels in accordance with the drive signal; wherein the steering damper is actively controlled by the controller.

14. The device of claim 13, wherein the steering damper is configured to damp movement of the fork attached thereto.

15. The device of claim 13, further comprising a steering actuator configured to turn the fork under the control of the controller.

16. The device of claim 13, further comprising at least one sensor for detecting a position of one of the first and second cross skate bodies relative to the other and forming corresponding relative location information (RLI).

17. The device of claim 16, wherein the controller controls at least one of the first traction motor and the second traction motor in accordance with the RLI.

18. A cross-skate device comprising:

first and second cross skate bodies each having a frame configured to support at least first and second wheels situated inline of each other, each frame having at least one compartment configured to position a corresponding power source of first and second power sources;

a steering damper coupled to each frame and configured to damp steering motion of the corresponding first wheels;

first and second foot couplers, each foot coupler configured to couple a foot of a user to a corresponding cross skate body of the cross skate bodies;

a first traction motor coupled to drive at least one of the first and second wheels of the first cross skate body;

a second traction motor coupled to drive at least one of the first and second wheels of the second cross skate body; and a controller configured to: receive a drive signal from a drive controller, and control the first and second traction motors to drive the corresponding wheels in accordance with the drive signal, wherein the steering damper is actively controlled by the controller.

19. The device of claim 18, wherein the first and second traction motors comprise hub-type motors.

20. The device of claim 18, wherein the first and second traction motors are coupled to at least one of the first and second corresponding wheels with a belt or chain.

* * * * *